US005092133A

United States Patent [19]

Franklin

[11] Patent Number: 5,092,133

[45] Date of Patent: Mar. 3, 1992

[54] EUTECTIC SOLUTION AND $CO_2$ SNOW COOL TANK

[76] Inventor: Paul R. Franklin, 5211 W. Beaver St., Jacksonville, Fla. 32205

[21] Appl. No.: 638,816

[22] Filed: Jan. 8, 1991

[51] Int. Cl.[5] ..... F25D 3/00

[52] U.S. Cl. ..... 62/59; 62/121; 62/307; 62/384; 62/388; 62/434

[58] Field of Search ..... 62/384, 388, 434, 59, 62/121, 307

[56] References Cited

U.S. PATENT DOCUMENTS

| | | | |
|---|---|---|---|
| 3,670,522 | 6/1972 | Breslin | 62/434 |
| 4,502,293 | 3/1985 | Franklin, Jr. | 62/388 |
| 4,766,732 | 8/1988 | Rubin | 62/384 |
| 4,848,095 | 7/1989 | Franklin | 62/388 |
| 4,924,935 | 5/1990 | Van Winkel | 62/434 |

*Primary Examiner*—Ronald C. Capossela
*Attorney, Agent, or Firm*—Fleit, Jacobson, Cohn, Price, Holman & Stern

[57] ABSTRACT

A vented cold tank is provided and partially filled with a eutectic solution. $CO_2$ snow forming structure is provided within the interior of the tank above the level of eutectic solution therein and liquid $CO_2$ injection structure is provided in an lower portion of tank below the level of eutectic solution and arranged to create circulation of the eutectic solution within the tank including generally opposite upper and lower horizontal components of movement and generally opposite vertical components of movement of the solution within the tank. The $CO_2$ injection structure also is operative to educt a portion of the circulating solution from a lower portion of the interior of the tank adjacent the bottom thereof, mix $CO_2$ snow with the educted portion of solution, and downwardly direct the mixed $CO_2$ snow and educted portion of solution on to an area of the surface of the solution within the tank substantially at the beginning of the upper horizontal component of eutectic solution circulation within the tank.

9 Claims, 1 Drawing Sheet

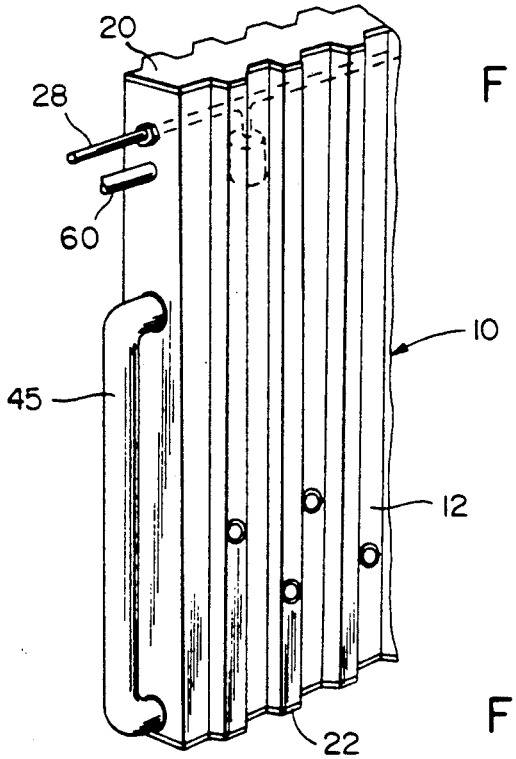
FIG. 1
FIG. 2
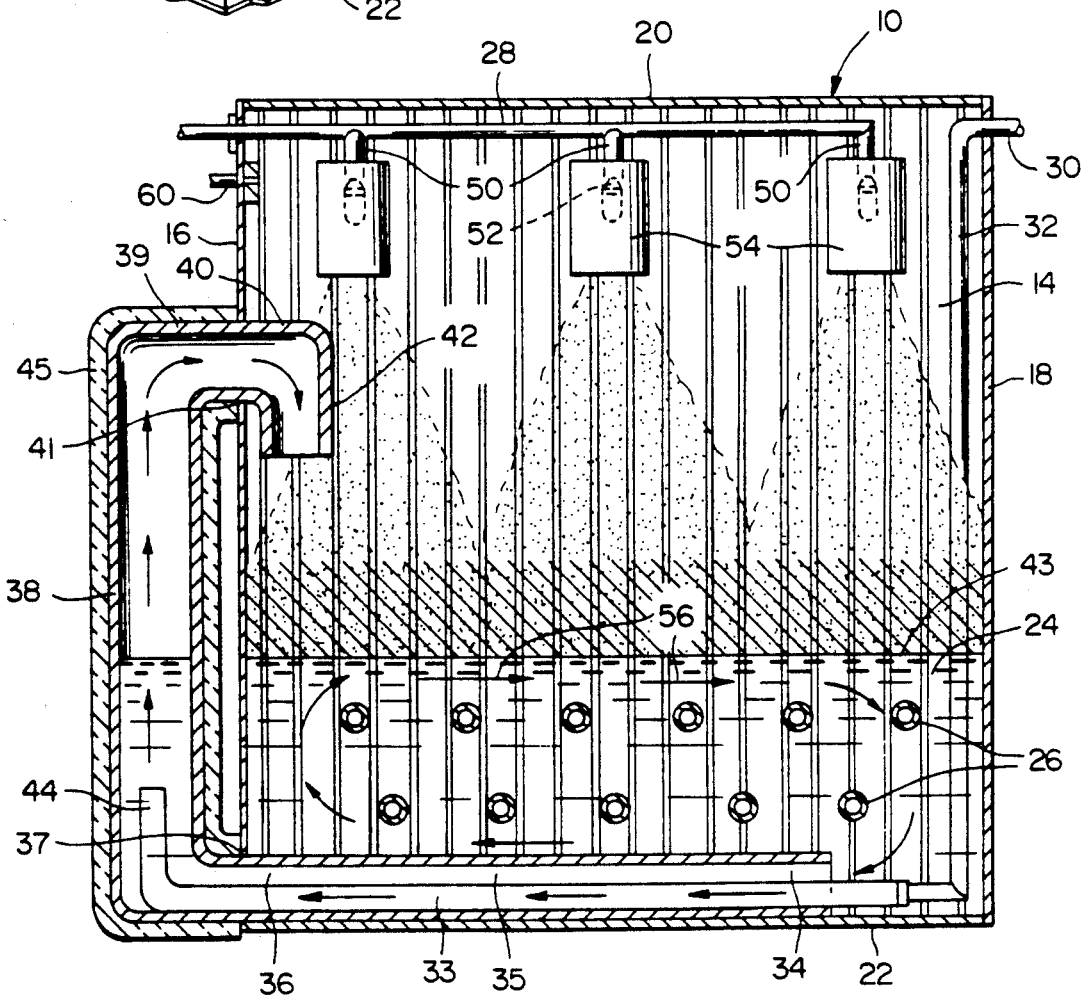

EUTECTIC SOLUTION AND $CO_2$ SNOW COOL TANK

CROSS REFERENCE TO RELATED APPLICATION

This application discloses an improvement over the COOL TANK CONSTRUCTION FOR EUTECTIC SOLUTION AND $CO_2$ SNOW disclosed in my prior U.S. patent application Ser. No. 07/190,109, filed May 4, 1988 (now U.S. Pat. No. 4,848,095) the disclosure of which is incorporated herein by reference.

BACKGROUND OF THE INVENTION

1. Field of the Invention

This invention relates to a closed, but vented, receptacle contructed of good heat transfer material and partially filled (approximately ⅓) with a eutectic solution. The upper portion of the interior of the receptacle includes $CO_2$ spray head structure for forming $CO_2$ snow therein, which snow may fall down upon the surface of the eutectic solution, and the lower portion of the interior of the receptacle includes structure for creating a predetermined path of circulation of eutectic solution within the approximate ⅓ lower portion of the receptacle, which circulation of eutectic solution is accomplished by jet discharging liquid $CO_2$ into the inlet end portion of a circulation pipe including a horizontal leg disposed in the bottom of the receptacle and opening outwardly of one side wall of the receptacle adjacent the bottom thereof, a vertical leg extending upwardly from the end of the horizontal leg opening outwardly of the receptacle side wall and an upper L-shaped leg extending inwardly through an upper portion of a side wall of the tank above the level of eutectic solution therein and terminating inwardly in a down turned outlet end portion, the down turned outlet end portion being disposed above the surface of the eutectic solution in an area thereof remote from the inlet end portion of the first mentioned horizontal leg of the circulation pipe. All portions of the circulation pipe disposed exteriorly of the receptacle being covered by a suitable insulating covering.

2. Description of Related Art

My prior U.S. Pat. No. 4,848,095, dated July 18, 1989 discloses all of the instant invention, except for the circulation pipe of the instant invention.

SUMMARY OF THE INVENTION

The instant invention provides an improved method and apparatus for obtaining, in a cold tank or the like, appreciably greater heat absorbing capacity through the utilization of a given amount of liquid $CO_2$. In addition, the instant invention provides an apparatus and method for more rapidly chilling the eutectic solution within a cool tank or the like.

The main object of this invention is to provide a more efficient manner of cooling the eutectic solution within a cool tank through the utilization of liquid $CO_2$.

Another object of this invention is to provide a cool tank "charging" apparatus and method which does not require any outside power source other than a source of liquid $CO_2$ under pressure.

A final object of this invention to be specifically enumerated herein is to provide a cold tank in accordance with the preceding objects and which will conform to conventional forms of manufacture, be of simple construction and dependable in operation so as to provide a device which will be economically feasible, long-lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a fragmentary perspective view of a cool tank constructed in accordance with the present invention; and FIG. 2 is an enlarged longitudinal vertical sectional view of the cool tank.

DESCRIPTION OF THE PREFERRED EMBODIMENT

Referring now more specifically to the drawings the numeral 10 generally designates a cool tank such as that disclosed in my prior U.S. Pat. No. 4,848,095, dated July 18, 1989. The cool tank 10 includes large area opposite side walls 12 and 14 and smaller area opposite end walls 16 and 18. The end walls 16 and 18 interconnect corresponding ends of the side walls 12 and 14 and the latter include vertically extending corrugations to increase the surface area thereof. Further, top and bottom walls 20 and 22 extend between and interconnect the upper and lower marginal portions of the walls 12, 14, 16 and 18. The interior of the tank 10 is approximately ⅓ filled with any suitable eutectic solution 24 (for instance, a 3:1 mixture of water and propylene glycol having a freezing temperature of approximately −20 degrees F.).

The lower portion of the tank 10 includes transversely extending heat exchange air-flow tubes 26 extending between and sealingly secured through the side walls 12 and 14.

A liquid $CO_2$ header pipe 28 is disposed in the upper portion of the tank 10 and extends longitudinally thereof. The header pipe 28 opens through the end wall 16 from a suitable supply of liquid $CO_2$ under pressure. Further, a $CO_2$ supply line or pipe 30 enters into the upper portion of the interior of the tank through the end wall 18 and is immediately downwardly directed as at 32 to a position closely adjacent the bottom wall 22. The lower end of the supply line 30 includes a horizontally directed leg 33 extending lengthwise of the bottom wall 22 and which projects into the open inlet end portion 34 of a first horizontal leg 35 of a eutectic solution circulation pipe 36.

The horizontal leg 35 of the circulation pipe 36 projects outwardly through the end wall 16 as at 37 in fluid tight sealed engagement therewith and terminates in an upwardly directed leg 38 of the circulation pipe 36 which projects above the level 4 of eutectic solution 24 in the tank 10. The upwardly directed leg 38 terminates upwardly in an L-shaped outlet end portion 39 including a horizontal leg 40 opening inwardly through the end wall 16 as at 41 in fluid tight sealed engagement therewith and terminating inwardly in a downwardly directed leg 42 spaced above the level 43 immediately inward of the end wall 16 and considerably remote from the inlet end 34 of the circulation pipe 36. The horizontal leg 33 of the supply line 30 terminates in a upwardly directed outlet end 44 within the leg 38 and at a level spaced below the level 43.

All portions of the circulation pipe 36 disposed exteriorly of the tank 10 and the end wall 16 are covered with suitable insulation 45 for a purpose to be hereinafter more fully set forth.

The header pipe 28 includes a plurality of downwardly directed discharge lines 50 spaced therealong and each discharge line 50 is communicated with one or more spray discharge outlets 52 each disposed within a downwardly opening horn 54. Spray discharge of liquid $CO_2$ under pressure from the outlets 52 results in $CO_2$ snow being formed within the horns 54 and dropping downwardly onto the surface of the eutectic solution 24. In addition, the spray discharge of liquid $CO_2$ from the outlet end 44 of the supply line 30 in an upward direction in the leg 38 of the circulating pipe 36 acts as an eductor to draw eutectic solution 24 into the inlet end portion 34 of the circulation pipe 36 and for eutectic solution 24 to be driven upwardly through the leg 38 of the circulation pipe 36 and out through the outlet end portion 39 through the open lower end of the downwardly directed leg 42. Of course, the circulation of eutectic solution through the circulation pipe 36 causes the circulation of the eutectic solution 24 within the tank 10 as indicated by the arrows 56 shown in FIG. 2. In addition, additional $CO_2$ snow is formed by the $CO_2$ being discharged from the downwardly directed leg 42.

The circulation as indicated at 56 causes $CO_2$ snow already formed to mix and circulate with the eutectic solution 24 and to quickly reduce the temperature thereof to a level nearing the temperature of the $CO_2$ snow without excess build-up of $CO_2$ snow on the surface of the eutectic solution 24.

When the eutectic solution 24 has been sufficiently chilled to form a slush-like mixture, the desired chilling operation is almost completely accomplished and the discharge of liquid $CO_2$ from the header pipe and the supply line 30 is allowed to continue for only a short time thereafter (according to the size of the tank 10 and the rate of discharge of liquid $CO_2$).

A cooling tank 10 is primarily designed to be used in insulated truck bodies (although the tank 10 may be exteriorly mounted) and a certain amount of time is required together with a certain amount of liquid $CO_2$ in order to fully chill the tank 10 and the eutectic solution 24.

As is accomplished by the tank disclosed in my prior U.S. Pat. No. 4,848,095, if the liquid $CO_2$ supplied to the header pipe 28 and the supply line 30 comprises the same supply of liquid $CO_2$. Therefore, as the eutectic solution 24 reaches a slush-like consistency and the supply line 30 experiences a resultant build-up of resistance pressure, excess pressure in the supply line 30 is avoided by such excess pressure being vented through the header pipe 28 to form additional $CO_2$ snow on top of the eutectic solution 24.

In addition, it is important that the upwardly directed leg 38 of the circulation pipe 36 be disposed exteriorly of the tank 10 in order to avoid excess cooling of that portion of the circulation pipe 36 into which the liquid $CO_2$ is discharged, which excess cooling could cause the circulation pipe 36 to be prematurely blocked by substantially solidified eutectic solution 24. Of course, the insulation 45 is provided to avoid excess heat absorption by the upwardly directed leg 38 of the circulation pipe 36 exteriorly of the tank 10.

The rate of $CO_2$ supplied to the supply line 3 is greater than the rate of $CO_2$ supplied to the header pipe 28. Further, the upper portion of the tank 10 is vented to the ambient atmosphere through vent tube 60.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A cold tank including a quantity of eutectic solution therein to a level appreciably below the top of the tank, $CO_2$ snow forming means in an upper portion of said tank operative to form $CO_2$ snow within the tank above the level of eutectic solution therein for falling of the $CO_2$ snow by gravity down onto the surface of said eutectic solution, liquid $CO_2$ injection means disposed in said tank below said surface and operative to effect a circulatory movement of eutectic solution partially within and partially outside said tank with said circulatory movement including generally opposite horizontal and generally opposite vertical components of movement of said solution within said tank, and means for supplying liquid $CO_2$ under pressure to said $CO_2$ snow forming means and said liquid $CO_2$ injection means.

2. The cold tank of claim 1 wherein said liquid $CO_2$ injection means includes a circulation pipe including inlet and outlet end portions, said inlet end portion opening into said tank below said surface and adjacent one wall of said tank, said circulation pipe extending from said inlet end portion toward and out through another wall of said tank remote from said one wall, upwardly along the exterior of said tank and thereafter back inwardly of said tank with said outlet end portion opening downwardly over an area of said level remote from said one tank wall, said liquid $CO_2$ injection means also including a $CO_2$ supply line including an inlet end disposed exteriorly of said tank and an outlet end portion extending into said circulation pipe through the inlet end portion thereof and terminating in said circulation pipe below said level.

3. The tank of claim 2 wherein said outlet end portion of said supply line terminates in the upwardly directed portion of said circulation pipe disposed exteriorly of said tank.

4. The cold tank of claim 3 wherein at least substantially all of the portions of said circulation pipe disposed exteriorly of said tank are covered with a suitable heat insulative layer.

5. The tank of claim 4 wherein said tank includes large plan area upstanding opposite side walls interconnected by smaller plan area opposite end walls, said one wall comprising one of said opposite end walls and said wall remote from said one wall comprising the other of said end walls.

6. The tank of claim 5 wherein the flow rate of liquid $CO_2$ through said injection means is greater than the flow of rate of liquid $CO_2$ through said snow forming means.

7. The tank of claim 1 including means venting the interior of said tank above said surface to the exterior of said tank.

8. The tank of claim 5 wherein said tank includes top and bottom walls extending between and interconnecting upper and lower marginal edge portions of said side and end walls, said circulation pipe an inlet end portion closely paralleling said bottom wall and extending, from its inlet end closely adjacent one of said end walls, through the other end wall in fluid tight sealed engagement therewith.

9. The method of rapidly cooling a liquid eutectic solution to a slush-like mixture within a cold tank having said eutectic solution therein to a level spaced appreciably below the upper extremity of the interior of said tank, said method comprising causing $CO_2$ snow to fall by gravity down onto the surface of said eutectic solution, providing liquid $CO_2$ injection means within said tank below said level and arranged therein to create circulation of said liquid eutectic solution within said tank including generally opposite horizontal upper and lower components of movement of said solution within said tank and generally opposite vertical components of movement of said solution within said tank and with said liquid $CO_2$ injection means also functioning to educt a portion of said eutectic solution from a lower portion of said tank, mix $CO_2$ snow with the educted portion of eutectic solution and downwardly discharge the mixed $CO_2$ snow and educted portion of eutectic solution onto an area of said surface disposed substantially at the beginning of the upper horizontal component of the circulatory movement of eutectic solution within said tank.

* * * * *